US009915008B2

(12) United States Patent
Binder et al.

(10) Patent No.: US 9,915,008 B2
(45) Date of Patent: Mar. 13, 2018

(54) PROCESS FOR PRODUCING A SOL-GEL COATING ON A SURFACE TO BE COATED OF A COMPONENT AND ALSO CORRESPONDING COMPONENT

(71) Applicants: SÜDDEUTSCHE ALUMINIUM MANUFAKTUR GMBH, Böhmenkirch (DE); HANS UND OTTMAR BINDER GBR, Böhmenkirch (DE)

(72) Inventors: Hans Binder, Böhmenkirch (DE); Ottmar Binder, Böhmenkirch (DE); Markus Kreitmeier, Böhmenkirch (DE)

(73) Assignees: SUDDEUTSCHE ALUMINIUM MANUFAKTUR GMBH, Bohmenkirch (DE); HANS UND OTTMAR BINDER GBR, Bohmenkirch (DE)

( * ) Notice: Subject to any disclaimer, the term of this patent is extended or adjusted under 35 U.S.C. 154(b) by 260 days.

(21) Appl. No.: 14/434,401

(22) PCT Filed: Oct. 8, 2013

(86) PCT No.: PCT/EP2013/070981
§ 371 (c)(1),
(2) Date: Apr. 8, 2015

(87) PCT Pub. No.: WO2014/056944
PCT Pub. Date: Apr. 17, 2014

(65) Prior Publication Data

US 2015/0259818 A1 Sep. 17, 2015

(30) Foreign Application Priority Data

Oct. 8, 2012 (DE) ..... 10 2012 019 969
Oct. 8, 2012 (DE) ..... 20 2012 009 726 U
Dec. 5, 2012 (WO) ..... PCT/EP2012/074457

(51) Int. Cl.
*C25D 11/04* (2006.01)
*C25D 11/18* (2006.01)
(Continued)

(52) U.S. Cl.
CPC ..... *C25D 11/24* (2013.01); *C23C 18/122* (2013.01); *C23C 18/1254* (2013.01);
(Continued)

(58) Field of Classification Search
CPC ..... C25D 11/024; C25D 11/04
See application file for complete search history.

(56) References Cited

U.S. PATENT DOCUMENTS 8,999,133 B2 * 4/2015 Isurugi ..... B29C 33/424 205/108
2005/0150771 A1 7/2005 Kock et al.
(Continued)

FOREIGN PATENT DOCUMENTS

EP 1 835 002 A2 9/2007
EP 1 884 578 A1 2/2008
(Continued)

*Primary Examiner* — Brian W Cohen
(74) *Attorney, Agent, or Firm* — Seager, Tufte & Wickhem, LLP

(57) ABSTRACT

The disclosure concerns a process for producing a sol-gel coating on a surface of a component made of aluminum or of an aluminum alloy that is to be coated, comprising the following steps: anodization of the surface through the application of an electrical voltage over a particular time period so as to form an anodized layer on the surface; and deposition of a sol-gel coating on the surface. In doing so, the voltage applied for purposes of anodizing is, by way of a particular potential gradient, continuously increased in the direction of a holding voltage that is maintained throughout the rest of the anodization time, in particular up to the
(Continued)

holding voltage. The disclosure furthermore concerns a component made of aluminum or an aluminum alloy.

7 Claims, 2 Drawing Sheets

(51) Int. Cl.

| | |
|---|---|
| ***C25D 11/24*** | (2006.01) |
| ***C25D 5/18*** | (2006.01) |
| ***C25D 21/12*** | (2006.01) |
| ***C25D 11/02*** | (2006.01) |
| ***C23C 18/12*** | (2006.01) |

(52) U.S. Cl.
CPC ..... *C25D 11/024* (2013.01); *C25D 11/04* (2013.01); *C25D 11/18* (2013.01)

(56) References Cited

U.S. PATENT DOCUMENTS

| | | | | |
|---|---|---|---|---|
| 2008/0261033 | A1* | 10/2008 | Binder ..... | B05D 1/18 428/336 |
| 2008/0311362 | A1* | 12/2008 | Binder ..... | B05D 1/18 428/210 |
| 2009/0061216 | A1 | 3/2009 | Levendusky et al. | |
| 2009/0148711 | A1 | 6/2009 | Le Blanc et al. | |

FOREIGN PATENT DOCUMENTS

| | | | | |
|---|---|---|---|---|
| EP | 1884578 | A1 * | 2/2008 | ..... B01D 67/006 |
| EP | 1 970 214 | A2 | 9/2008 | |
| EP | 1 970 256 | A2 | 9/2008 | |
| EP | 1 980 651 | A2 | 10/2008 | |
| EP | 2 128 659 | A1 | 12/2009 | |
| WO | 2012029570 | A1 | 3/2012 | |
| WO | 2013139899 | A2 | 9/2013 | |

* cited by examiner

PROCESS FOR PRODUCING A SOL-GEL COATING ON A SURFACE TO BE COATED OF A COMPONENT AND ALSO CORRESPONDING COMPONENT

CROSS-REFERENCE TO RELATED APPLICATIONS

This application is a National Stage of International Application No. PCT/EP2013/070981, filed Oct. 8, 2013, which claims the benefit of International Patent Application No. PCT/EP2012/074457, filed Dec. 5, 2012, German Patent Application No. 20 2012 009 726.1, filed Oct. 8, 2012, and German Patent Application No. 10 2012 019 969.4, filed Oct. 8, 2012, the entire disclosures of which are incorporated herein by reference.

SUMMARY

The disclosure concerns a process for producing a sol-gel coating on a surface of a component made of aluminum or of an aluminum alloy that is to be coated, comprising the following steps: anodization of the surface through the application of an electrical voltage over a particular time period so as to form an anodized layer on the surface; and deposition of a sol-gel coating on the surface. In doing so, the voltage applied for purposes of anodizing is, by way of a particular potential gradient, continuously increased in the direction of a holding voltage that is maintained throughout the rest of the anodization time, in particular up to the holding voltage. The disclosure furthermore concerns a component made of aluminum or an aluminum alloy.

BRIEF DESCRIPTION OF THE DRAWINGS

The disclosure may be more completely understood in consideration of the following detailed description in connection with the accompanying drawings, in which.

Figure 1:
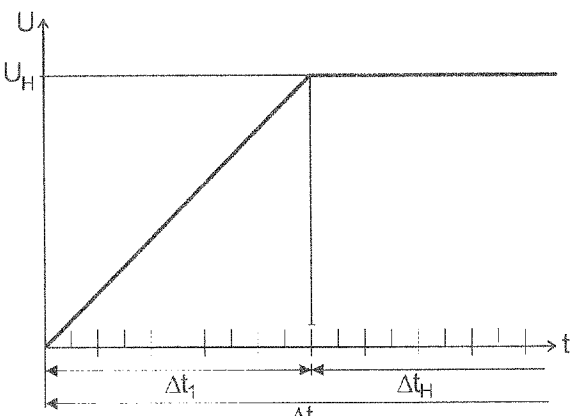
FIGS. 1 to 7 show graphs in which the course of the voltage that is applied for purposes of anodizing is plotted as a function of time for different embodiments of the process of this disclosure.

While the disclosure is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the disclosure.

The invention concerns a method for producing a sol-gel coating on a surface of a component made of aluminum or of an aluminum alloy that is to be coated, comprising the following steps: Anodizing the surface by applying an electrical voltage for a certain anodization time period so as to form an anodized layer on the surface; and formation of the sol-gel coating on the surface. The invention furthermore concerns components made of aluminum or of an aluminum alloy that is producible in this way. The invention furthermore also concerns particularly readily cleanable sol-gel-coated components made of aluminum or an aluminum alloy.

The anodizing as well as the application of a sol-gel coating onto the surface of a component made of aluminum and/or an aluminum alloy for purposes of protecting the surface from environmental influences is basically known in the state of the art. Both processes yield a surface that is, in particular, insensitive to oxidation, but is nevertheless readily cleanable and visually attractive.

It is now the object of the invention to provide a process for producing a sol-gel coating and components producible therefrom, which exhibit the advantage that the sol-gel coating adheres better to the surface of the component. The corrosion resistance and/or the ready cleansability of the surface are additionally to be increased even more.

This is achieved by way of a process as disclosed herein. This specifies that the voltage applied for purposes of anodizing is continually increased from the start of the anodization time period, with a prescribed voltage gradient in the direction of the holding voltage that is maintained over the rest of the anodization time. The potential gradient is, e.g., at most 0.5 V/s. Anodization causes the material in the surface region to be selectively oxidized and/or altered so that that an oxide layer is formed. Anodizing produces an anodized layer, in particular an oxide coating on the surface, which protects deeper layers of the component against corrosion. The anodized layer can also be called a protective layer.

The component is at least partly, but in particular completely, immersed into an electrolyte bath for purposes of anodization. An electrical voltage is thereafter applied to the component for the specified anodizing time, while the component is preferably used as the anode and an electrode placed in the tank containing the electrolyte is used as the cathode. The tank itself or at least a region of the tank can alternatively be used as the cathode. Anodization can be also called anodic oxidation.

In conventional processes the voltage is set to the holding voltage at the start of the anodization time period, so that a sudden voltage jump to the holding voltage takes place. On the other hand, according to this invention, the applied voltage is preferably to be increased continuously up to the holding voltage, in particular from a voltage of 0V at the start of the anodization period. This is particularly preferably accomplished by way of the specific potential gradient, which can, e.g., be constant. The potential gradient is, in particular, finite at any point in time; there is thus no voltage jump as in the process according to the state of the art. It can be either arranged to initially only increase the voltage in the direction of the holding voltage or to increase it up to the holding voltage via a specific gradient. The potential gradient is, e.g., at most 20 V/s, at most 10 V/s, at most 7.5 V/s, at most 5 V/s, at most 3 V/s or at most 2 V/s, but preferably at most 1 V/s, at most 0.5 V/s, at most 0.25 V/s, at most 0.1 V/s, at most 0.075 V/s, at most 0.05 V/s, at most 0.025 V/s or at most 0.01 V/s.

The holding voltage is then the voltage that is retained over the remainder of the anodization time period. This remainder of the anodization time period has a duration of more than zero seconds. The remainder of the anodization time period—which can be also called voltage hold time—is, e.g., at least as long as the time period from the start of the anodization time period to the time when the holding voltage is first reached. The latter time period can also be called the voltage buildup time period. The whole anodization time thus consists of two domains, i.e. the sum of the voltage buildup time and the voltage hold time. The duration of the voltage hold time is preferably a multiple of the duration of the voltage buildup time; it is thus for example at least twice, at least three times, at least four times or at least five times as long. The potential gradient is for example averaged over the voltage buildup time. It does not have to be constant throughout the voltage buildup time. It is exactly this that can be provided for. The potential gradient is however preferably finite at any time, as described above; the course of the voltage over time is thus constant.

The voltage applied for anodizing is preferably understood to be a target voltage, which is set on the anodization equipment used for anodizing. An actually existing working voltage can then either correspond to the target voltage or it can run behind it with a time delay. The working voltage preferably corresponds to the target voltage at all times; it can however occasionally deviate at least slightly from the target voltage. The applied voltage can however alternatively also be regarded as the actually existing working voltage. For example, the voltage during an anodization is pre-specified, so that the current adjusts itself accordingly. The current thus lags behind the voltage in this case.

Changing, in particular increasing, the voltage at the start of the anodizing period can be considered to be a "ramp-up" of the voltage. This ramp-up is accomplished during the voltage buildup period, after which the holding voltage is reached and is then maintained during the voltage hold time. The voltage buildup period has a duration of, e.g., at least one second, at least two seconds, at least three seconds, at least four seconds, at least five seconds, at least 7.5 seconds or at least 10 seconds, but preferably least 15 seconds, at least 30 seconds, at least 45 seconds, at least 60 seconds, at least 120 seconds, at least 180 seconds, at least 240 seconds, at least 300 seconds, at least 450 seconds or at least 600 seconds.

The lower the electrical voltage applied for anodizing the surface is, the smaller are the cells formed at the beginning of the anodizing period. A larger number of cells per unit area are therefore formed at a lower voltage, and correspondingly a larger number of pores as well. It is assumed that this higher number of pores favors the mechanical bonding of the sol-gel coating to the anodized surface. A variation of the parameters used for anodizing the surface, in particular the voltage, therefore leads to topographically different anodization layers at the surface. The porous structure of the sol-gel coating can be produced in a reproducible way via the process of this invention. The current density can additionally or alternatively be selected as a parameter. In accordance with an alternative embodiment of this process, the current density can also be increased toward a holding current density and/or up to the holding current density for a specified period of time, having a specified length.

The surface of the component is preferably to be processed mechanically to and/or to be cleaned and/or degreased before it is anodized. The mechanical processing can for example be in the form of polishing, sanding and/or brushing. Pickling or chemical cleaning is particularly applicable for cleaning and/or degreasing. The processing and/or cleaning operation is preferably performed immediately before anodizing.

The formation of the sol-gel coating on the surface for example comprises the following steps: application of a dispersion to the surface, with a coating material being colloidally suspended in the dispersion; drying the dispersion so as to form a gel film on the surface; and curing the gel film so as to form the sol-gel coating. The application of the dispersion to the surface takes place, for example, immediately after anodizing. The dispersion contains a coating material as a colloid. The coating material is, for example, formed by hydrolysis and condensation of at least one precursor and/or a precursor compound of the dispersion. The hydrolysis and the condensation then, for example, proceed in part simultaneously and in competition. The coating material can also alternatively or additionally be added in order to produce the dispersion.

The dispersion can be produced in the form of a colloidal solution. The latter preferably not only contains the coating, in particular in the form of particles, but also a polymer network which at least partly cross-links the particles. This polymer network, e.g., consists of silanes.

Precursors for the dispersion can e.g. be alcoholates of metals and/or nonmetals. A silicon precursor is particularly useful, e.g. tetramethyl orthosilicate (TMOS), tetraethyl orthosilicate (TEOS) or tetraisopropyl orthosilicate (TPOT).

But it is also possible to alternatively or additionally employ alcoholates of other metals, transition metals or nonmetals, e.g. alcoholates of aluminum or titanium. the dispersion comprises a solvent, e.g. ethanol and/or water, in addition to the alcoholate. A catalyst, in particular an acidic or alkaline catalyst, can be present as an additional component. A suitable acidic catalyst is, e.g., hydrogen chloride and/or hydrochloric acid. Nitric acid, acetic acid or sulfuric acid, or a mixture of these acids can additionally or alternatively also be used. Sodium hydroxide and/or a caustic soda solution is for example used as the alkaline catalyst.

The hydrolysis can for example be described by the equation $$M(OR)_n+H_2O \rightarrow M(OR)_{n-1}OH+ROH,$$

while the condensation is described by $$(RO)_mM\text{-}OH+HO\text{-}M(OR)_m \rightarrow (RO)_mM\text{-}O\text{-}M(OR)_m+H_2O.$$

Here M is a metal and/or a metalloid, e.g. silicon.

The dispersion is in the form of a sol. One can distinguish between an alcohol-based sol (ethanol is used as the solvent) and a Hydrosol (water is used as the solvent) depending on the solvent being employed. The coating material, which is present in the form of colloids, is formed by way of the reactions proceeding in the dispersion respectively in the sol, in particular the hydrolysis and the condensation.

The dispersion is dried after it is applied, so that a gel film, in particular xerogel film, is formed on the surface. Drying is understood to signify at least a partial, in particular a complete, extraction and/or removal of the solvent that was employed from the dispersion. Depending on the method used for applying the coating, the drying of the dispersion can already occur when it is applied, because the layer thickness of the dispersion is usually low, at least when the viscosity of the dispersion is low compared with the extent and/or the size of the surface. The solvent can accordingly evaporate rapidly, even under normal ambient conditions.

The drying of the dispersion is, e.g., initiated immediately after the dispersion is applied and/or it proceeds automatically. The gel film on the surface and/or on the anodized layer, wherein a loose network of the coating material is present, is formed once the dispersion has dried. The network can then still not yet be completely interlaced and it accordingly has a high porosity of, e.g., at least 50%. This means, in particular, that no bonding has occurred in the case of at least a fraction the particles of the coating material.

For this reason the gel film can be hardened so as to produce the final form of the sol-gel coating. This hardening operation is usually performed at a high temperature of at least 100° C., at least 110° C., at least 120° C., at least 130° C., at least 140° C., at least 150° C., at least 200° C., at least 250° C., at least 300° C., at least 350° C. or at least 400° C. This hardening preferably transforms the gel film into a solid ceramic layer having a low porosity, i.e. into the sol-gel coating. The aforesaid temperatures are preferably specified as a so-called "peak metal temperature" (PMT), which occurs in the component during the hardening process, i.e. as the maximum temperature of the component.

The resulting layer thickness of the sol-gel coating is, e.g., 0.5 μm to 10 μm, in particular 1 μm to 5 μm, particularly preferably 1 μm to 2 μm. The layer thickness is advantageously at least 1 μm, at least 2 μm, at least 5 μm or at least 10 μm. The dispersion is accordingly applied with a layer thickness by means of which the desired final layer thickness is achieved. The drying and hardening are also performed with parameters by means of which the desired layer thickness of the sol-gel coating can be achieved. The hardening of the gel film mot preferably takes place immediately after the dispersion, by means of which the gel film is trained is dried.

In a further embodiment of the invention, the voltage in time intervals sequentially following the start of the anodization period is increased to the holding voltage with specific potential gradients, with the potential gradients for immediately adjacent time periods being different from each other. Said time periods are parts of the voltage buildup time period, which starts at the beginning of the anodization time period and lasts until the holding voltage is first reached via the applied voltage.

The holding voltage is thus not reached by way of a single time interval, during which the voltage is continuously increased. Several such time intervals are provided for instead, in every one of which the voltage is increased with a respective specific potential gradient. As previously stated above, the potential gradient is preferably finite and it can additionally be constant, at least during a respective interval, or alternatively variable. The potential gradient is, at least in the latter case, understood to be, e.g., the average potential gradient during the respective time interval. The potential gradient is nevertheless preferably finite at any time within the respective time interval, so that the progression of the voltage is constant over the time. The voltage is equal to zero at the start of the first time period, which lies at the start of the anodization time. At the end the last of the successive time intervals it is equal to the holding voltage. It is however additionally or alternatively also possible for at least one interval to have a constant or even a decreasing voltage.

The time intervals preferably follow each other directly. It is in principle possible for the potential gradients in successive time intervals, in particular those directly following each other, to be different from each other. The potential gradient is, in this case as well, for example at most 20 V/s, at most 10 V/s, at most 7.5 V/s, at most 5 V/s, at most 3 V/s or the most 2 V/s, but preferably at most 1 V/s, at most 0.5 V/s, at most 0.25 V/s, at most 0.1 V/s, at most 0.075 V/s, at most 0.05 V/s, at most 0.025 V/s or at most 0.01 V/s.

It can be possible for the potential gradient selected for the first of the time intervals to be smaller than in immediately following second time intervals. This is particularly the case if the potential gradient in the respective two time intervals is constant. As has previously been described above, it is possible for a low or lower voltage at the start of the anodization time period to cause the cells and/or pores formed by way of the anodization to be smaller in size than via a higher voltage. If the first time interval, in which the potential gradient is small, lies at the start of the [entire] anodization time, a large number of pores is formed on the surface because the voltage increases slowly.

Although the voltage increases more rapidly during second time interval, the number of pores is no longer reduced, but on the contrary it is only the speed with which the anodized by means of anodization that increases. It is possible for the increase of the voltage to the holding voltage to occur in only the first and the second time intervals, so that no additional time intervals are provided for and so that the holding voltage is reached in the second time interval.

In another embodiment of the invention, the anodized layer is compacted, in particular only partially compacted, at a specified compacting temperature after it is anodized and after the dispersion has been applied. It is self-understood that the dispersion is applied immediately after the surface has been anodized on and/or after the anodized layer has been applied. But the compacting or partial compacting is advantageously performed first, in order to at least partly plug the pores on a side facing the environment of the component and/or to reduce the sizes of their openings on the side facing their environment. The compacting operation is, for example, performed as a hot compression in demineralized water or as a cold compression.

After the compaction, the anodized layer has active hydroxyl groups, which are created by via the compression process and which promote chemical bonding of the sol-gel coating, particularly of the silanes present therein. It is for this reason that the compaction is of fundamental advantage. But, if the anodized layer is fully compacted, the drying of the dispersion and/or the hardening of the gel film can lead to the formation of fractures in the anodized layer. These reduce the advantageous visual appearance of the component carrying the sol-gel coating. It is for this reason that the anodized layer is preferably only partly compacted.

This can for example occur in manner such that a full compaction time period after which full compaction is found to occur, depending of the thickness of the anodized layer, is determined, and the compression operation is only performed over a part of the full compression time period, in particular at most 90%, at most 75%, at most 50%, at most 25% or at most 10% thereof. The compaction is particularly advantageously performed only over at most 5%, at most 4%, at the 3%, at most 2%, at most 1%, at most 0.5%, at most 0.25%, at most 0.1%, at most 0.05% or at most 0.01% of the full compression time period.

The full compaction time period is usually selected to be he longer, the greater thickness of the anodized layer is. This is the time after which a certain fraction of the pores is fully compressed for the first time, i.e. are closed in relation to the environment. This portion is for example at least 90%, at least 95%, at least 99% or 100%.

If the compaction process occurs via hot compression, i.e., for example in water, in particular in emineralized water, at a temperature greater than 60° C., in particular a temperature greater than 70° C., greater than 80° C., greater than 90° C. or greater than 95° C., preferably greater than 100° C., then the duration $t_v$ of the full compaction period is, e.g., calculated in accordance with the following equation:

$$t_v = 3\ \text{min}/\mu\text{m} \cdot d,$$

where d is the thickness of the anodized layer. The duration $t_v$ of the full compaction time period can alternatively be specified by $$2.0\ \text{min}/\mu\text{m} \cdot d \leq t_v \leq 3.2\ \text{min}/\mu\text{m} \cdot d,$$

or $$2.2\ \text{min}/\mu\text{m} \cdot d \leq t_v \leq 3.2\ \text{min}/\mu\text{m} \cdot d.$$

If compaction is occurs via cold compression, e.g. at temperatures between 20° C. and 40° C., then the duration $t_v$ of the full compaction time period is, e.g., $$0.8\ \text{min}/\mu\text{m} \cdot d \leq t_v \leq 1.2\ \text{min}/\mu\text{m} \cdot d$$

For purposes of partial compaction, the component or at least the anodized layer is only treated for the specified portion of the full compression period, i.e. in the case of hot compression, by immersing it in demineralized water, at a temperature greater than 60° C.

In a particularly advantageous embodiment of the invention particles, particularly polymer particles, e.g. silicon dioxide particles, with a particle size of at most 30 nm, in particular at most 20 nm, preferably at most 10 nm, particularly preferably at most 6 nm or at most 4 nm are used as the coating material or as part of the coating material. The particles are for example formed, as described above, by way of reactions proceeding in the dispersion and/or in the sol, i.e. via hydrolysis and condensation. If a silicon alcoholate is used as a precursor, the particles are polysilicate particles, in particular silicon dioxide particles. The particles can of course additionally or alternatively be added for purposes of producing the dispersion, in particular added in addition.

The particle size is then, e.g., defined in the direction of greatest extent of the particles or alternatively as the particle diameters if they are round or spherical, respectively ball shaped or globular particles. The particle size can alternatively be understood to be the average particle diameter. For example all particles of the coating material, i.e. all particles present in the dispersion have the stated particle size. However this can alternatively this can apply to just a fraction of the coating material, so that particles with the stated particle sizes, but also e.g. larger particles can be present. In this case the particle size is understood to be the average particle size and/or the average particle diameter of all particles present in the dispersion. This average particle size is to fulfill the aforesaid conditions.

While the size of the particles is limited to a maximum by way the values specified above, their particle size is e.g. at least 2 nm, preferably at least 4 nm. In a particularly preferred embodiment, all particles of the coating material have particles sizes between 4 nm and 6 nm.

It has been found that the dispersions and/or sols that are produced are the more stable, the smaller the particle size is. If the particles are bigger, the dispersion is tends to precipitate. The corrosion resistance of the resulting sol-gel coating furthermore increases with decreasing particle size. This becomes evident when, e.g., a Kesternich test is performed on the component and/or on the surface.

In another embodiment of the invention, the dispersion is produced by mixing several starting dispersions with particles having different particle sizes. Different particle sizes arise in different dispersions depending on the precursor and the concentration. These dispersions are called starting dispersions. The dispersion used for producing the sol-gel coating is then to be produced by mixing several of these starting dispersions, so that particles with different particle sizes are present in the dispersion.

This means that both "small" and "large" particles can be present in the dispersion, e.g. with the "small" particles having particle sizes of 2 nm to 10 nm, preferably from 4 nm to 6 nm, and the "large" particles particle having particle sizes of 10 nm to 30 nm, for example from 15 nm to 20 nm. The starting dispersions are intermixed at a certain mixing ratio for purposes of producing the dispersion.

The potential gradient, particularly the potential gradient at the beginning of the anodization time period, can furthermore be determined based on the particle size, with the potential gradient for smaller particles being smaller. As mentioned previously, the formed by anodizing have smaller dimensions with lower voltages than at higher voltages. This applies analogously to a smaller potential gradient, which is employed as of the start anodization period, because the voltage rises comparatively slowly.

The smaller the particle sizes of the particles present in the dispersion are, the smaller should the pores be as well in order to improve the bonding of the sol-gel coating, because smaller particles preferably accumulate immediately adjacent to the anodized surface and thus worsen the bonding of the of the sol-gel coating. This effect is at least partly compensated for by the smaller pores, which are obtained by way of the lower voltage and/or the slower voltage increase. The smaller particle sizes therefore improve the corrosion resistance of the component on the whole, without however a poorer bonding of the sol-gel coating to the surface having to be accepted in return.

It furthermore possible to add a fluorosilane and/or a fluorosilane formulation at a certain percentage by volume, preferably at most 10 vol.-%, at most 7.5 vol.-%, at most 5 vol.-%, at most 4 vol.-%, at most 3 vol.-%, at most 2 vol.-%, at most 1 vol.-% or at most 0.5 vol.-%, to the dispersion. Higher percentages by volume, e.g. of at most 25 vol.-%, at most 20 vol.-%, at most 15 vol.-%, can be also be employed. Compounds that contain fluorine have a hydrophobic effect. In known processes, the fluorosilane formulation and/or a fluorosilane is applied to the sol-gel coating after it has been hardened in the form of a top coat, in order to achieve this property. This is however disadvantageous because the fluorosilane and/or the preparation is removed from the surface over time, for example by abrasion, and it can additionally sometimes be damaging to health. These disadvantages are avoided by mixing the fluorosilane and/or the fluorosilane formulation into the dispersion.

It is for this reason that the fluorosilane and/or the preparation is added directly to the dispersion, so that it is still present in the sol-gel coating after it is hardened. The hydrophobic effect can also be achieved in this way. It is however disadvantageous that the fluorosilane and/or the preparation can have a negative effect on the bonding of the sol-gel coating to the surface. This is also due to its hydrophobic or "repulsive" effect. However tests have now surprisingly shown that the use of particles with a small particle size in accordance with the foregoing embodiments can reduce this negative effect of the fluorosilane and/or the preparation.

The particles apparently displace the fluorosilane and/or the preparation from the anodized surface, so that it is subsequently no longer present in the boundary layer of the sol-gel coating bordering on the anodized layer. It is instead displaced toward the outside environment. This additionally leads to an extremely advantageous increase of the concentration of the fluorosilane and/or the preparation on the side of the sol-gel layer facing the environment, whereby the hydrophobic effect there is further improved.

All in all the addition of the fluorosilane and/or the preparation thus produces a readily cleanable surface without disadvantages in the binding of the sol-gel coating to the surface having to be accepted. This is particularly the case if low particle sizes are used in accordance with the foregoing embodiments, in particular particle sizes of at most 10 nm, at most 8 nm, at most 6 nm or at most 4 nm.

The percentage by volume of the fluorosilane and/or of the formulation added to the dispersion is between from 1 vol.-% to 5 vol.-%, particularly from 1.25 vol.-% to 2.75 vol.-%, from 1.5 vol.-% to 2.5 vol.-% or from 1.75 vol.-% to 2.25 vol.-%, preferably 2 vol.-%. The fluorosilane formulation can be a fluoroalkyl silane, or a fluoroalkyl substituted silane, in particular 3,3,4,4,5,5,6,6,7,7,8,8,8-tridecafluorooctyl triethoxysilane. This compound is for example obtainable from Evoniktg6 under the name "Dynasylan® F 8261". The fluorosilane preparation can contain at least one solvent, for example an isopropanol and/or a water in addition to the silane.

The invention additionally concerns a component of aluminum or an aluminum alloy, in particular an automobile part, with a sol-gel coating applied to a surface of the component, that is producible or produced by means of a process in accordance with the foregoing embodiments. The advantages of this method have already been discussed. The component and the process can be developed further in accordance with the foregoing embodiments, so that reference to these is made to that extent.

To that extent the invention for example also concerns a component of aluminum or an aluminum alloy, in particular an automobile part, preferably produced with a sol-gel coating that is applied to a surface of the component by the method in accordance with the foregoing embodiments, with the surface having an anodized layer with a pore structure produced by anodization, and with the anodization being accomplished by means of the application of an electrical voltage over a certain anodization time for purposes of forming the anodized layer at the surface. The component is example an automobile part, in particular as a close-fitting automobile part. To that extent, the component can be a decorative automobile part. The sol-gel coating is particularly exposed to the outside, i.e. acted upon by outsite conditions.

The pore structure is preferably produced such that a voltage that is applied in order to perform the anodization is increased continually by way of a specific potential gradient from the start of the anodization time period toward a holding voltage that is maintained over the remainder of the anodization time, in particular up to the holding voltage. The potential gradient is then for example at most 0.5 V/s; but the aforesaid potential gradients can also be used. The component is preferably produced by means of the aforesaid method. The component and the process can be advanced further in accordance with the foregoing embodiments, so that reference to these is made to that extent.

A void structure, which has a very high pore density, is formed as a result of the special implementation of the anodization. It is accordingly well suited for achieving excellent bonding of the sol-gel coating.

The invention particularly also concerns a component of aluminum or an aluminum alloy, in particular an automobile part, with as anodized layer deposited onto a surface of the component, onto the surface of which a sol-gel coating is in turn applied, with the sol-gel coating containing particles with a particle size of at most 30 nm and a fluorosilane dispersed in the sol-gel coating. This embodiment is more fully described herein.

The invention lastly concerns equipment for producing a sol-gel coating on a surface of a component made of aluminum or an aluminum alloy, in particular by employing the method in accordance with the foregoing embodiments, with the equipment being designed to perform the following steps: anodization of the surface by applying an electrical voltage for a specific anodization time period so as to form an anodized layer at the surface; and formation the sol-gel coating on the surface. It is furthermore ensured that the voltage applied for anodizing is continuously increased, by way of a specific potential gradient, toward a holding voltage that is maintained over the remainder of the anodization time, in particular up to the holding voltage. The potential gradient is then for example at most 0.5 V/s or it is selected in accordance with the foregoing embodiments.

The aforesaid equipment is preferably designed to implement the process according to this invention. The foregoing embodiments, in particular the embodiments concerning the process, can accordingly be similarly drawn on for the equipment, which can be designed or developed further accordingly for purposes of implementation. Each possible embodiment of the process can then be allocated to a corresponding design of the equipment.

The invention is hereafter elucidated by means of the example embodiments in the drawing, without this restricting the invention. FIGS. 1 to 7 show graphs in which the course of the voltage that is applied for purposes of anodizing is plotted as a function of time for different embodiments of the process of this invention.

Each of the FIGS. 1 to 7 plots the course of a voltage U as a function of the time t for at least a part of one anodization time period. The voltage U is applied for purposes of anodizing a surface of a component made of aluminum or an aluminum alloy during one anodization period with a duration of $\Delta t_E$, in order to deposit an anodized layer in the surface. At the beginning of the anodizing period, the voltage is increase continuously via a specific gradient toward a holding voltage that is maintained for the remainder of the anodization time with a duration of $\Delta t_H$, in particular up to this voltage. At the end of the anodization time, the current flow is interrupted and the voltage U is this set equal to zero.

From the start of the anodization period, several successive time intervals with durations of $\Delta t_1$, $\Delta t_2$ and so on can be used, in which the voltage U follows a certain path toward the holding voltage $U_H$, i.e. for example by way of a certain potential gradient, and/or it is increased up to the holding voltage $U_H$. It is, of course, also possible for the voltage to remain constant or even to decrease in one of the time intervals.

The time period from the beginning of the anodization period, at which the voltage is preferably equal to zero, until the holding voltage $U_H$ is first reached can be called voltage buildup period. The latter consists of the successive periods with a duration of $\Delta t_1$, $\Delta t_2$ and so on. To the voltage buildup period is followed immediately by the remainder of the anodization time period, which can also be called voltage holding time period. The duration of the voltage holding time period corresponds to the duration of the voltage construction period is, e.g., at least as long as the duration of the voltage buildup time period or even a multiple thereof. The voltage holding time period is for example, three times, four times or five times as long as the voltage buildup time period.

In the example embodiment shown in FIG. 1, the voltage buildup time only extends over a single time period with the duration of $\Delta t_1$, during which the voltage is increased continuously to the holding voltage $U_H$ with a constant potential gradient. Thereafter the voltage remains constant over the [entire] holding voltage time period. The example embodiments of the FIGS. 2 to 7 have two time periods, i.e. with a duration $\Delta t_1$ and $\Delta t_2$, which jointly constitute the voltage buildup time period. In this case as well the voltage buildup period is followed immediately by the voltage holding time period.

Figure 2:
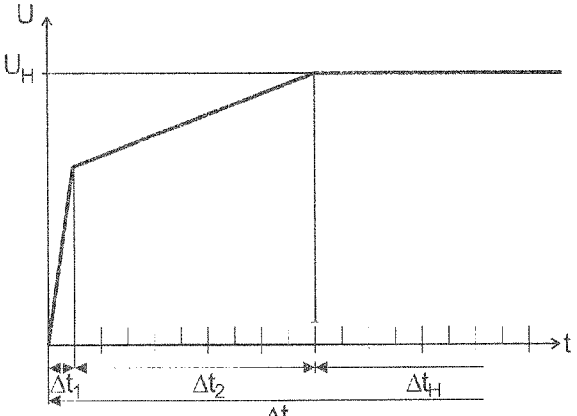
Figure 3:
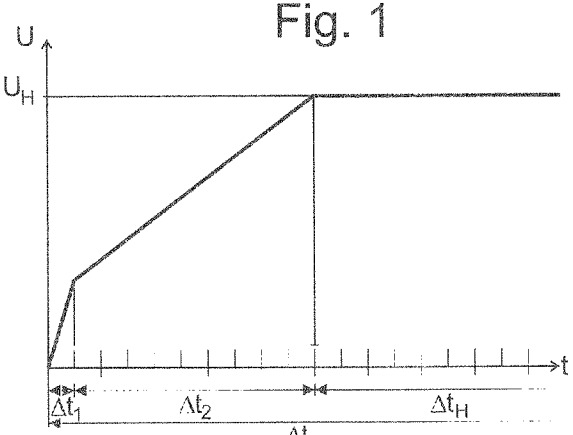
Figure 4:
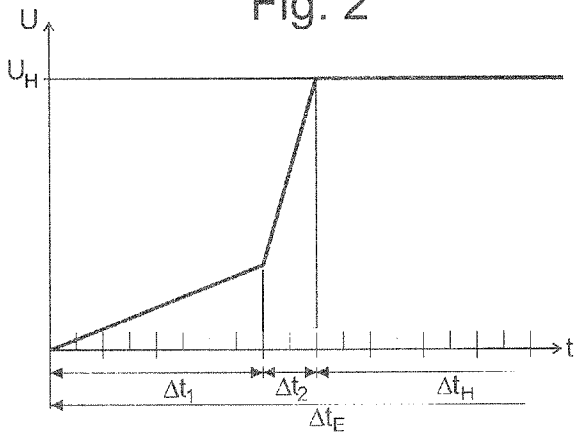
Figure 6:
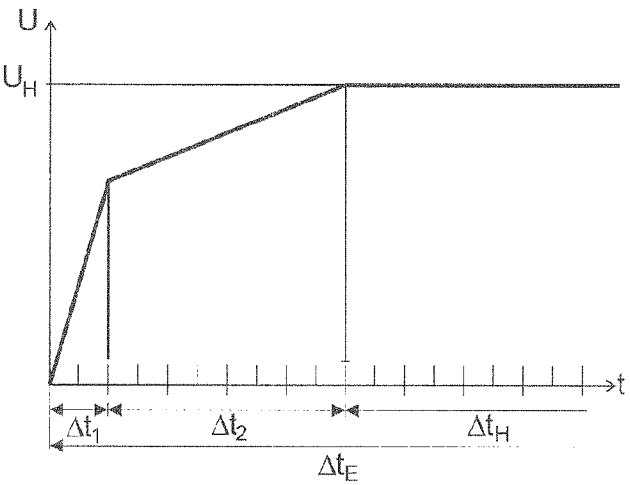
Figure 5:
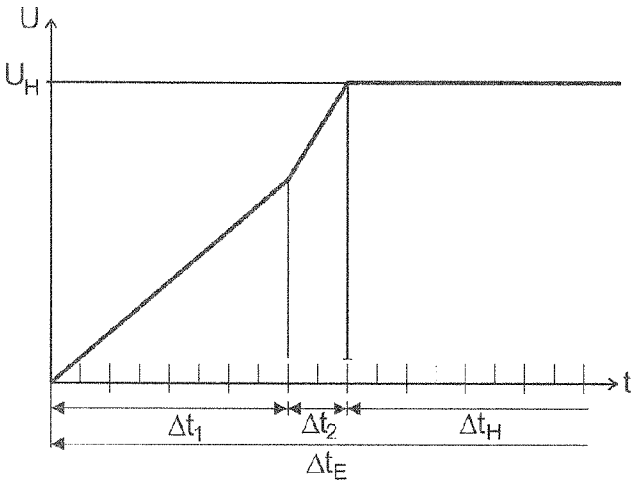
Figure 7:
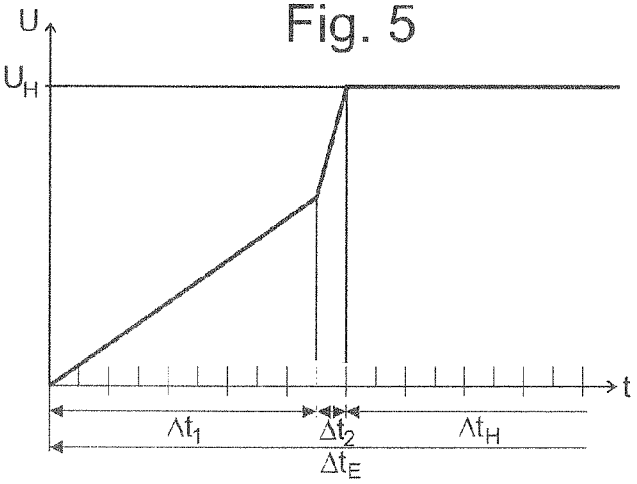

In the case of the example embodiments of the FIGS. 2 and 6 the first time period is shorter than the second time period ($\Delta t_1 < \Delta t_2$), while the reverse case applies to FIGS. 4, 5 and 7 ($\Delta t_1 < \Delta t_2$). In the case of the example embodiments of FIGS. 2, 3 and 6 is the potential gradient in the first time period is higher than in the second period. The reverse applies again to the example embodiments of FIGS. 4, 5 and 7. The voltage buildup period in all example embodiments extends over a period of, e.g., at least 15 seconds, at least 30 seconds, at least 45 seconds, at least 60 seconds, at least 120 seconds, at least 180 seconds, at least 240 seconds or (as represented in the figures) at least 300 seconds. But it takes at most 1200 seconds, at most 900 seconds, at most 600 seconds or the most 450 seconds. The holding voltage is, e.g., 10 V to 20 V, in particular 15 V.

The anodization of the surface is preferably followed by a partial compaction of the anodized layer produced via the anodization. This partial compaction is performed over a certain compression time period, which represents a part of a full compression time period. This full compression time period is determined as a function of the thickness of the anodized layer using equations applicable thereto. The full compaction time period thus describes the period, during which a compaction must be performed in order to fully compact the anodized layer, i.e. the length of time up to the time at which a most, i.e. at least 90%, at least 95% or at least 99% of the pores of the anodized layer are initially completely closed off with respect to the environment of the component.

In the case of the example embodiment of the Figure I the partial compaction is performed by means of one compaction period of 30 seconds at the temperature of a fluid used to accomplish the compaction, for example demineralized water, at 70° C. In the case of the example embodiments of the FIGS. 2 to 7 the compaction times are respectively 30 seconds, 80 seconds, 60 seconds, 180 seconds, 60 seconds and respectively 200 seconds, while the temperatures are 65° C., 70° C., 98° C., 95° C., 90° C. and respectively 80° C.

After the partial compaction a dispersion is applied to the surface and/or to the anodized layer on top of it. In the dispersion contains a colloidal dispersion of a coating material, with particles, in particular silicon dioxide particles, with a certain particle size, being used as the coating material. The preferred particle size for the example embodiments of the FIGS. 1 to 3, 6 and 7 is 10 nm to 20 nm and for the example embodiments of the FIGS. 4 and 5 4 nm it is 6 nm. The dispersion is preferably dried after it is applied for purposes of creating a gel film and the gel film is hardened for purposes of producing the sol-gel coating.

The invention claimed is:

1. A process for producing a sol-gel coating on a surface of a component made of aluminum or of an aluminum alloy, the process comprising:

anodization of the surface of the component by applying an electrical voltage for an anodizing time period so as to produce an anodized layer on the surface of the component, wherein the applied electrical voltage is continuously increased by way of at least one potential gradient from a start of the anodizing time period up to a holding voltage, wherein the holding voltage is applied over the remainder of the anodizing time period to produce the anodized layer, formation of the sol-gel coating on the surface of the anodized layer of the component, wherein the formation of the sol-gel coating comprises:

application of a dispersion onto the surface of the anodized layer, wherein the dispersion comprises a coating material dispersed in the dispersion as a colloid comprising particles, drying the dispersion so as to form a gel film on the surface of the anodized layer, and hardening the gel film to form the sol-gel coating, and wherein the at least one potential gradient is at most 20 V/s and the at least one potential gradient is selected and applied based on a desired particle size of the particles wherein the particle size is at most 30 nm.

2. The process according to claim 1, wherein the electrical voltage is increased up to the holding voltage wherein in sequential time periods subsequent to the start of the anodizating time period potential gradients of immediately adjacent time periods differing from each other.

3. The process according to claim 1, wherein a first potential gradient of the at least one potential gradient during a first time period is smaller than a second potential gradient of the at least one potential gradient during an immediately following second time periods.

4. The process according to claim 1, wherein, after the anodization is performed and before the dispersion is applied, the anodized layer is at least partially compacted.

5. The process according to claim 4, wherein a full compaction time is determined as a function of the anodized layer thickness.

6. The process according to claim 1, wherein the particles are polysilicate particles.

7. The process according to claim 1, wherein a fluorosilane and/or a fluorosilane formulation containing at most 10 vol.-% is mixed into to the dispersion as an additive.

* * * * *